United States Patent [19]

Cooke et al.

[11] 4,199,205

[45] Apr. 22, 1980

[54] REFRIGERATOR CABINET CONSTRUCTION

[75] Inventors: Ralph C. Cooke; James D. Wilkerson, Jr., both of Louisville, Ky.

[73] Assignee: General Electric Company, Louisville, Ky.

[21] Appl. No.: 943,608

[22] Filed: Sep. 18, 1978

[51] Int. Cl.[2] ..... F25D 11/00; A47B 81/00

[52] U.S. Cl. ..... 312/214; 312/236; 312/296; 264/46.5

[58] Field of Search ..... 312/214, 236, 296; 264/46.4, 46.5, 46.7

[56] References Cited

U.S. PATENT DOCUMENTS

| | | | |
|---|---|---|---|
| 2,807,942 | 10/1957 | Dahlgren | 312/236 |
| 3,078,003 | 2/1963 | Kesling | 312/214 |
| 3,276,167 | 10/1966 | Bus et al. | 312/296 |
| 3,380,615 | 4/1968 | Kessler | 312/214 |
| 3,489,477 | 1/1970 | Harder, Jr. | 312/236 |
| 3,512,323 | 5/1970 | Hupfer | 264/46.5 |
| 3,633,783 | 1/1972 | Aue | 312/214 |
| 3,989,328 | 11/1976 | Nonomaque et al. | 312/214 |
| 4,056,211 | 11/1977 | Zumwalt | 312/296 |
| 4,134,627 | 1/1979 | Kuskowski | 312/296 |

*Primary Examiner*—Victor N. Sakran

*Attorney, Agent, or Firm*—Frank P. Giacalone; Radford M. Reams

[57] ABSTRACT

A refrigeration appliance cabinet provided with an improved foam stop and insulation element at a front edge portion of the cabinet. The element may be formed of a rigid polyurethane foam to provide improved insulation characteristics around the front edge portion by providing in combination the rigid foam insulation with the foamed-in-place insulation.

9 Claims, 3 Drawing Figures

REFRIGERATOR CABINET CONSTRUCTION

BACKGROUND OF THE INVENTION

This invention relates to a cabinet construction and in particular to refrigeration appliance cabinet construction.

Insulated wall structures are known wherein the cabinet wall structure includes an inner panel, an outer shell panel, and a body of foamed-in-place insulation therebetween. A sheet of fibrous materials has been employed to extend across the space defined by the front edges of the panels to define a boundary of the foamed-in-place insulation, and permit a removable installation of a breaker strip between the front panel edges.

In some instances the technique of foaming-in-place, the insulation is foamed in the space between the inner and shell panel by introduction of the foamable material into the top of the space with the front edges of the panel lowermost. The space between the front edges may be closed by fiberglass strips to provide a resilient section in which electrical conductors and refrigerant conduits may be located.

In U.S. Pat. No. 3,989,328 of Nonomaque et al a strip of rigid foam is provided for closing the front opening between the inner liner and outer shell panel of the appliance cabinet. The rigidity of the foam strip permits the strip to serve as a means for holding the liner centered in the inner cabinet shell panel during the assembly thereof.

SUMMARY OF THE INVENTION

The present invention relates to an improved refrigeration appliance cabinet construction wherein the refrigeration appliance has an outer shell and an inner liner cooperatively defining an insulation space therebetween for receiving foam-in-place insulation. The front edge of the shell and the front edge of the liner define a continuing front opening. The outer shell has a front portion and a flange portion that is bent inwardly to a position substantially parallel to the outer shell to provide a holding area defined by the outer shell front portion and the flange.

A strip of rigid foam is provided that is dimensioned to engage between the shell and liner adjacent the front opening for closing the front opening. The strip includes a wall section and first and second portions as formed at its longitudinal edges. The first portion is dimensioned to be securely held in the holding area in the front edge of outer shell while the second portion engages the front edge of the inner liner so as to prevent leakage of the foamed-in-place insulation from the insulation space between the shell and liner.

The back side of the wall portion of the strip facing the insulation space is provided with ribs projecting therefrom to engage the outer shell so that the second portion of the strip is maintained in contact with the inner liner while providing an insulation space between the wall and outer shell so that the foamed-in-place insulation extends into the front opening area.

DESCRIPTION OF THE PREFERRED EMBODIMENT

Figure 1:
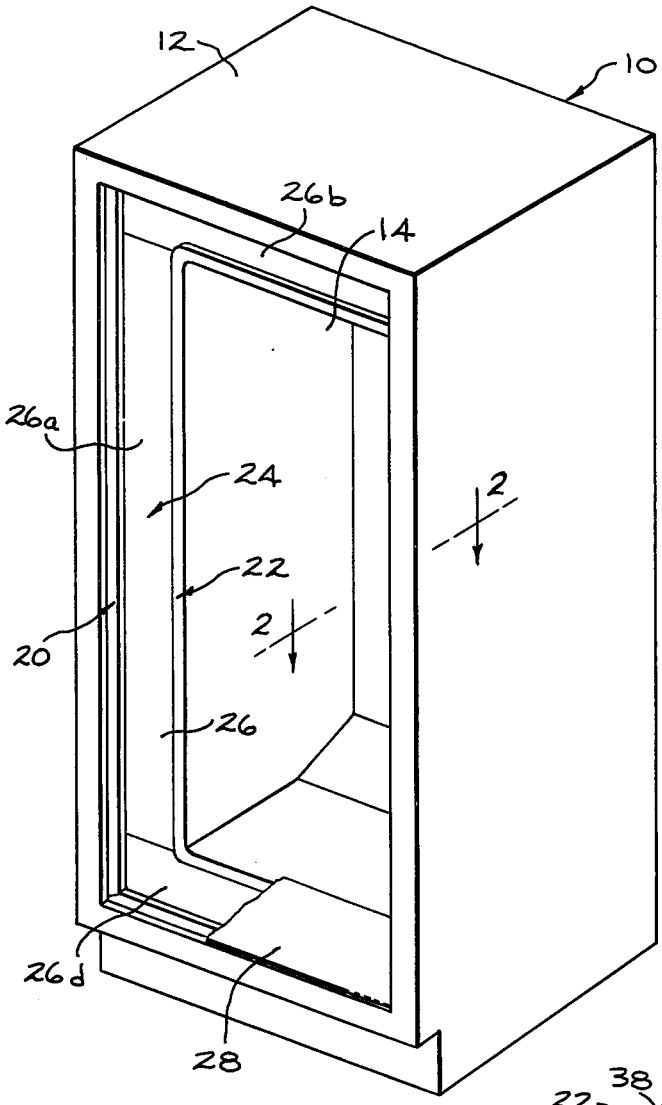
FIG. 1 is a perspective view with a portion broken away of a refrigeration appliance cabinet construction embodying the invention.

Referring now to the drawings and initially to FIG. 1 thereof, there is illustrated a refrigeration appliance cabinet construction generally designated 10. The cabinet 10 comprises an outer panel defining a shell 12 and an inner panel defining a liner 14. The present invention is adapted for use in any insulated cabinet wherein a body of foamed-in-place insulation 16, FIG. 2, is shown filling the area 18 between the outer shell 12 and the liner 14.

In the present invention, the front edges 20 of the shell 12 and the front edge 22 of the liner 14 define a continuous opening 24 in the front of the cabinet 10. The opening 24 is closed by the improved foam stop generally designated 26 which permits the foaming-in-place of the insulation 16. While the foam stop 26 because of its dimension may assist in centering the liner 14 relative to the shell 12 for preventing leakage of foam insulation outwardly through opening 24 during the foaming process it is not its function. In the process of foaming the area 18 means associated with the foaming fixtures (not shown) are employed to accurately position the shell 12 and liner 14 relative to each other. A conventional heat break trim illustrated at 28 arranged between the front edges of liner 14 and shell 12 to provide a finished appearance after assembly of the refrigerator cabinet 10 is complete.

Figure 2:
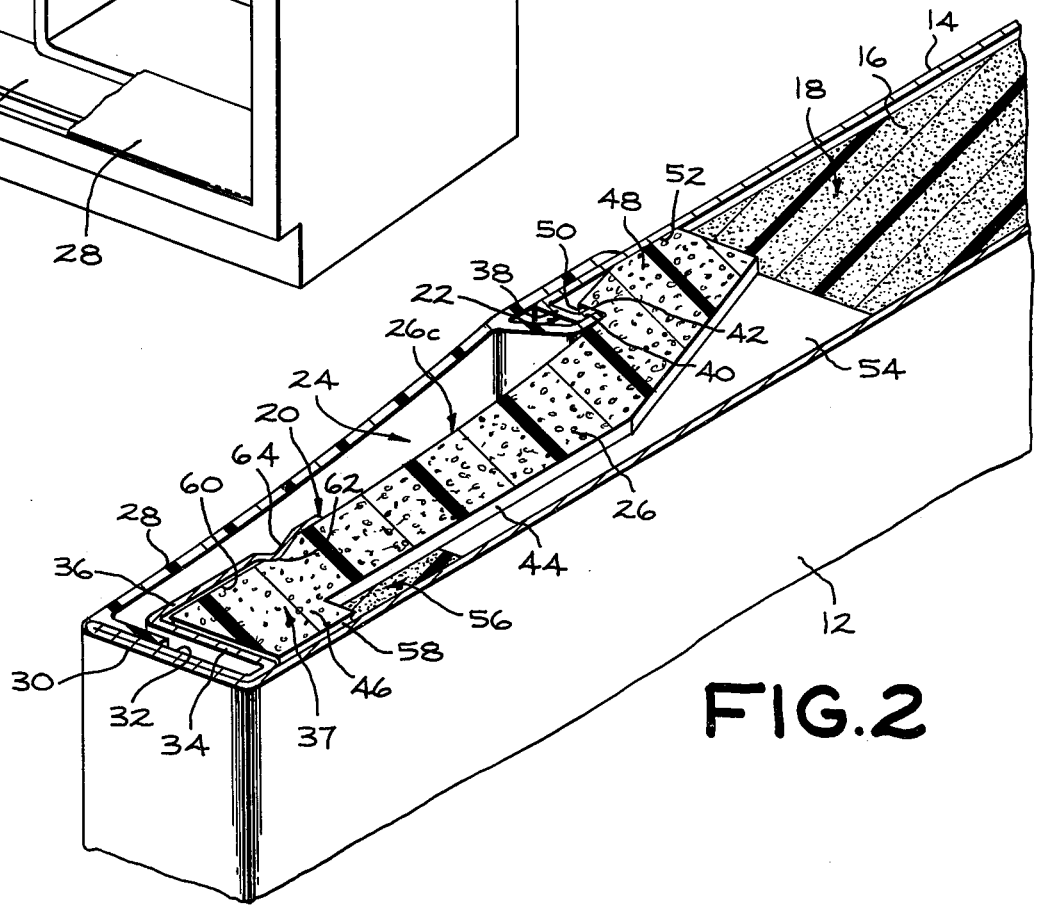
FIG. 2 is a fragmentary enlarged horizontal section thereof taken substantially along line 2—2 of FIG. 1.

As illustrated in FIG. 2 the front portion or edge 20 of shell 12 is defined by an inturned flange 30, a return flange 32, a second return flange 34 parallel with flanges 30 and 32, and a flange 36 extending rearwardly relative to cabinet 10 that is spaced from and substantially parallel to the outer wall of shell 12 to provide a holding area 37. The front portion of edge 22 of liner 14 is defined by an inwardly turned flange 38 and a rearwardly extending flange 40 defining at its distal end, a locating or support edge 42.

The foam stop 26 may be one continuous piece or any convenient number of pieces that extend along the opening 24 on the four sides of the cabinet. In the present instance for ease of handling there are provided four pieces **26*a*, 26*b*, 26*c* and 26*d* to completely cover opening 24, with the mating seams between the pieces arranged in each corner of opening 24**. Except for the mating construction in the end portions of the strips forming the corners which will be explained in detail hereinafter, each of the strips is substantially the same.

Strip 26 herein is preferably formed of a rigid material, such as rigid polyurethane foam, whch has been found to provide a superior insulation at the front opening 24. The strip 26 may have a K-factor substantially equal to that of the foamed-in-place insulation. It is to be understood that other rigid insulating material can be used but those with K-factors in the range of the foamed-in-place insulation are preferred.

Figure 3:
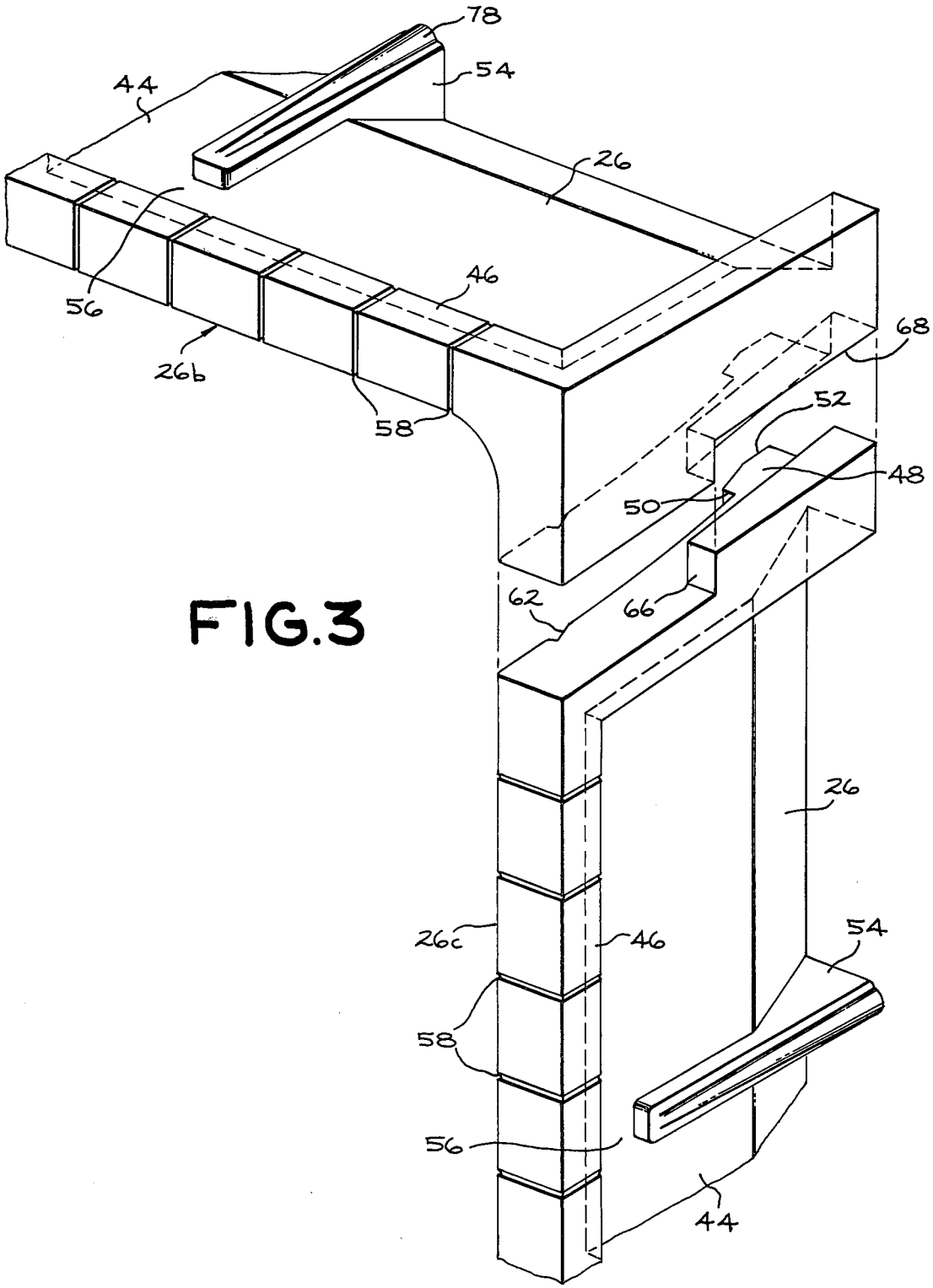
FIG. 3 is a perspective view of the foam stop element.

Generally as seen in FIGS. 2 and 3 the foam stop strip 26 includes a longitudinal central wall portion 44 that extends laterally across the opening 24. Formed along one edge of the wall portion 44 is a holding portion 46 which is dimensioned to fit snugly into the holding area 37 between the outer wall of shell 12 and flange 36. A second portion 48 is formed on the other edge of wall 44 which includes a surface 50 that is engaged by the distal end 42 of flange 40 and a surface 52 that engages the wall of liner 14. The engagement of surface 50 by edge 42 provides an additional seal between the area 18 and opening 24.

The surface 52 of portion 48 is maintained in contact with the wall of liner 14 by ribs 54 which are formed at spaced intervals along the surface of the wall 44 of strip 26. The ribs 54 extend along wall 44 from a position adjacent the rear edge of the strip 26 to a position spaced from portion 46 to provide a continuous longitudinal channel or area 56. The foamed-in-place insulation will fill the area between the ribs 54 and between the rear of wall 44 and the outer shell 12 including the area 56.

In addition of foamed-in-place insulation in combination with the rigid foam strip in the opening area 24 provides superior K-factor relative to providing a solid or complete ridged foam member.

The strip 26 may be retained to the shell 12 by mechanical securing means as illustrated in FIG. 2. To this end the wall section 60 of holding portion 46 adjacent the flange 36 is provided with a groove or recess 62 which engages a latching projection 64 formed in the flange 36. The strip 26 becomes bonded to the foamed-in-place insulation 16 during the foaming process and thus, the securing means is provided primarily to maintain the stip in position during the assembly of the liner 14 with shell 12 and during the foaming process.

The rigid foam members may also be provided with vent passages 58 formed at spaced intervals along the outer surface of portion 46. The passages are arranged to be adjacent the outer shell wall, flanges 34 and 36, to form a continuous vent passageway between the insulation area 18 and the opening 24. The passages are sized to be self-sealing with the foamed-in-place insulation during the foaming operation. The vent passages 58 permit gases involved in the foaming operation to escape from the insulation space 16 as the foam expands in the insulation space betweem the liner and shell. When the foam expands the foam entering passages 58 self-seal as they are plugged with expanding foam.

The ends of the strips *26a*, *26b*, *26c* and *26d* are provided with interlocking tabs so that the line defined by seam between the strip is tortuous and in effect self-sealing by foamed-in-place insulation in a manner similar to passages 58. To this end the ends of the strips *26a* and *26b* are provided with projections 66. As shown in FIG. 3 the projections 66 are dimensioned to fit or nest into recess 68 formed on the ends of the strips *26c* and *26d*. Accordingly an interlocking seam is provided that prevents a direct path for the foamed-in-place insulation to travel from the area 18 through opening 24.

During the process of constructing the cabinet 10 the strips 26 are first arranged in the outer shell 12 and then the liner 14 is positioned therein. The assembled shell and liner are then arranged on a fixture that insures that they are spaced to provide the proper predetermined insulation area. Generally the fixture securely holds the liner 12 and the outer shell walls are centered relative to the liner. To insure that the strip is in leakproof contact between the shell and liner the strip is provided with compressible projections or deformable members 78 formed on the ribs 54. In effect the dimension of the strip 26 between surface 52 and the outer edge of projection 78 is greater than the width of the insulation area 16 defined by the walls of the shell and liner. This assures that when the liner and shell are in their predetermined spaced relationship in that the projection 78 will in fact be compressed into its associated rib 54. This leak tight arrangement is accomplished without the danger of distorting the strip or ribs when the liner and shell are aligned by the foaming fixtures.

The foregoing is a description of the preferred embodiment of the invention and it should be understood that variations may be made thereto without departing from the true spirit of the invention as defined in the appended claims.

What is claimed is:

1. In a refrigeration appliance having an outer shell and an inner liner cooperatively defining an insulation space therebetween having a front opening, a flange portion substantially parallel to said outer shell defining a holding area therebetween;

a strip of rigid foam dimensioned for closing said front opening including a wall section having a first portion formed on one edge of said wall portion being dimensioned to be received in said holding area, a second portion formed on the other edge of said wall portion engaging said inner liner;

rib means projecting from said wall portion at spaced intervals extending from said wall portion to said outer shell to extend said insulation space between said wall and said outer shell in said front opening area.

2. The cabinet structure of claim 1 wherein holding means formed in said flange portion being arranged for engaging cooperating holding means on said first portion of said rigid foam for holding said rigid foam relative to said outer shell.

3. The cabinet structure of claim 2 wherein deformable members are formed on the outer surface of said rib means being engagable by said outer shell to insure contact between said second portion and said inner liner when said shell and liner are in accurately spaced relationship.

4. The cabinet structure of claim 3 wherein said rib means extends from substantially the end of said strip defined by said second portion to a position on said wall spaced from said first portion to provide a continuous insulation receiving area along said wall adjacent said first portion.

5. The cabinet structure of claim 4 wherein said holding area in said shell is defined by an inturned flange substantially perpendicular to said shell and said flange portion.

6. The cabinet structure of claim 5 wherein said first portion includes surface areas being dimensioned so that said surface areas to contact said shell, inturned flange and flange portion.

7. The cabinet structure of claim 6 wherein vent passages are arranged at spaced intervals in said first portion surface areas so as to communicate with said shell, inturned flange and said flange portion in said holding area to provide for venting gas from said insulation space during fo ming when said foaming-in-place of said insulation is performed.

8. The cabinet structure of claim 7 wherein said liner includes a locating edge portion spaced from said liner.

9. The cabinet structure of claim 8 wherein said second portion of said strip includes a first surface engaging said liner and a second surface engaging said locating edge.

* * * * *